US006401809B1

(12) United States Patent
Zhang et al.

(10) Patent No.: US 6,401,809 B1
(45) Date of Patent: Jun. 11, 2002

(54) CONTINUOUS COMBINATION FIN FOR A HEAT EXCHANGER

(75) Inventors: Chao Abraham Zhang, Macomb; Shyr-Ing Hu, Bloomfield Hills; Henry Mehraban, Plymouth; Ramez S. Abdulnour, West Bloomfield, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/458,416

(22) Filed: Dec. 10, 1999

(51) Int. Cl.[7] ..... F28F 13/02; F28D 1/02

(52) U.S. Cl. ..... 165/146; 165/111; 165/151; 165/152; 165/913

(58) Field of Search ..... 165/146, 151, 165/152, 913, 110, 111; 62/285, 290

(56) References Cited

U.S. PATENT DOCUMENTS

| | | | | |
|---|---|---|---|---|
| 3,003,749 A | * | 10/1961 | Morse | 165/152 |
| 3,759,050 A | | 9/1973 | Slaasted et al. | |
| 4,580,624 A | | 4/1986 | Ishida et al. | 165/152 |
| 4,615,384 A | | 10/1986 | Shimada et al. | |
| 4,676,304 A | * | 6/1987 | Koisuka et al. | 165/146 |
| 4,691,767 A | * | 9/1987 | Tanaka et al. | 165/151 |
| 4,723,599 A | * | 2/1988 | Hanson | 165/151 |
| 5,042,576 A | | 8/1991 | Broadbent | |
| 5,111,876 A | | 5/1992 | Nash | |
| 5,730,214 A | | 3/1998 | Beamer et al. | |
| 5,738,168 A | | 4/1998 | Patel et al. | |
| 5,752,567 A | | 5/1998 | Obosu | |
| 5,848,638 A | * | 12/1998 | Kim | 165/151 |

FOREIGN PATENT DOCUMENTS

| | | | | |
|---|---|---|---|---|
| JP | 58-12993 | * | 1/1983 | 165/913 |
| JP | 58-47992 | * | 3/1983 | 62/285 |
| JP | 58-140597 | | 8/1983 | |
| JP | 58-214793 | | 12/1983 | 165/152 |
| JP | 58-217195 | | 12/1983 | 165/913 |
| JP | 60-253792 | | 12/1985 | |
| JP | 63-15094 | * | 1/1988 | 165/150 |
| JP | 1-19290 | * | 1/1989 | 165/152 |
| JP | 5-196383 | | 8/1993 | |

* cited by examiner

*Primary Examiner*—Leonard Leo
(74) *Attorney, Agent, or Firm*—Larry I. Shelton

(57) ABSTRACT

A continuous combination fin for a heat exchanger includes a base wall having a first portion, a second portion and a third portion. The continuous combination fin also includes a plurality of entrance louvers in the first portion extending outwardly at a predetermined angle in a first direction from the base wall. The continuous combination fin includes a plurality of exit louvers in the third portion extending outwardly at a predetermined angle in a second direction from the base wall reversed from the first direction. The continuous combination fin further includes a plurality of drainage louvers in one of the first portion and the second portion and the third portion that are off-set relative to each other such that air flows through the entrance louvers and exit louvers and water drains through the drainage louvers.

20 Claims, 5 Drawing Sheets

FIG 1
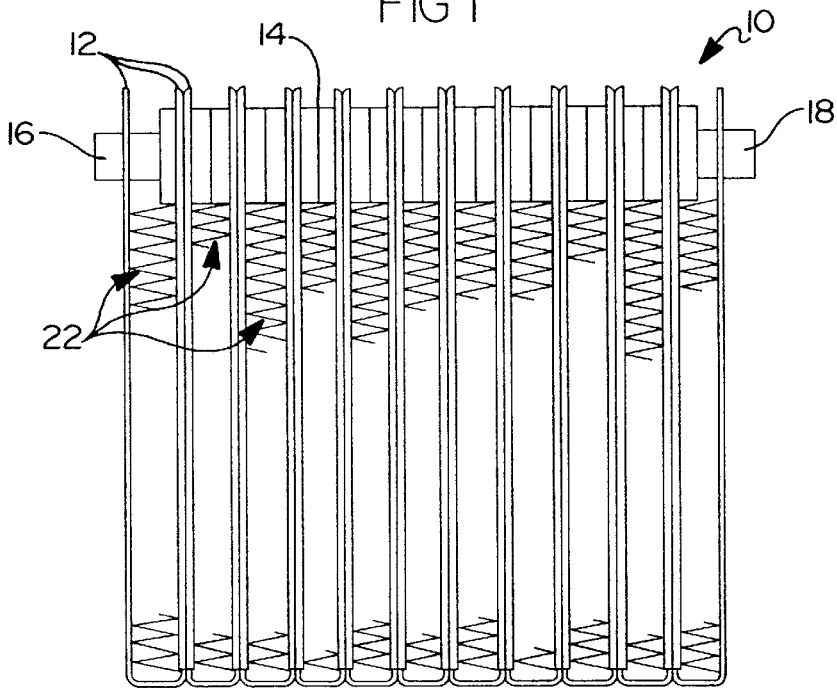
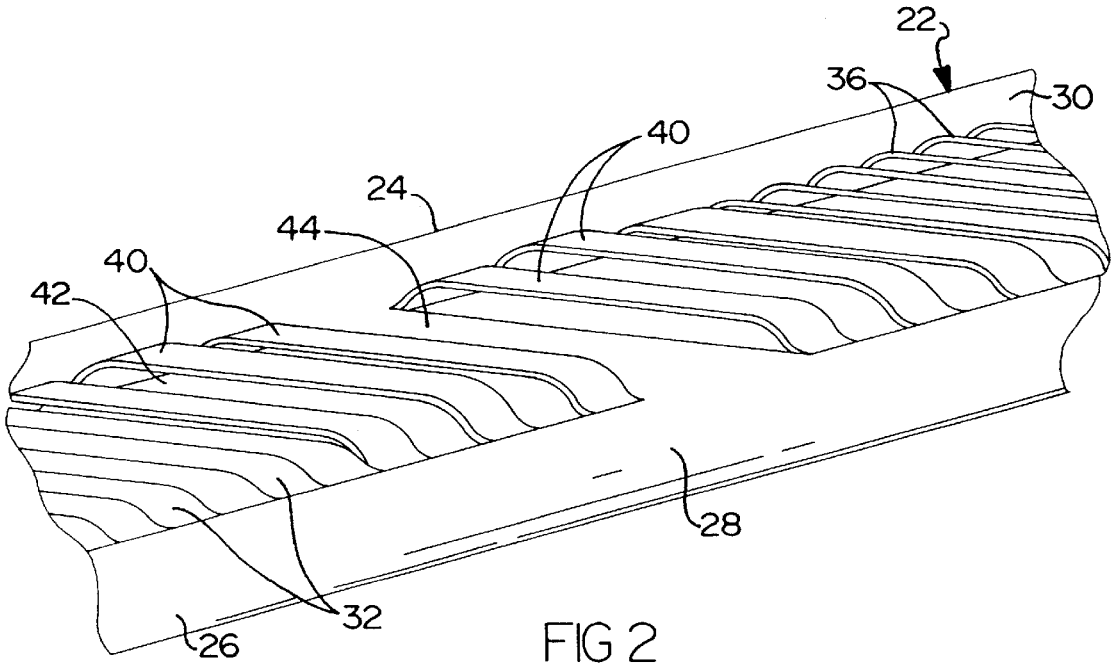
FIG 2

FIG 3
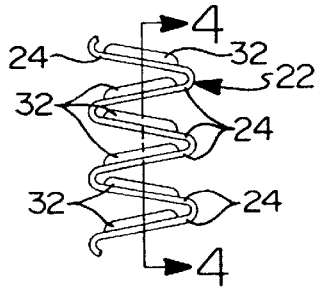
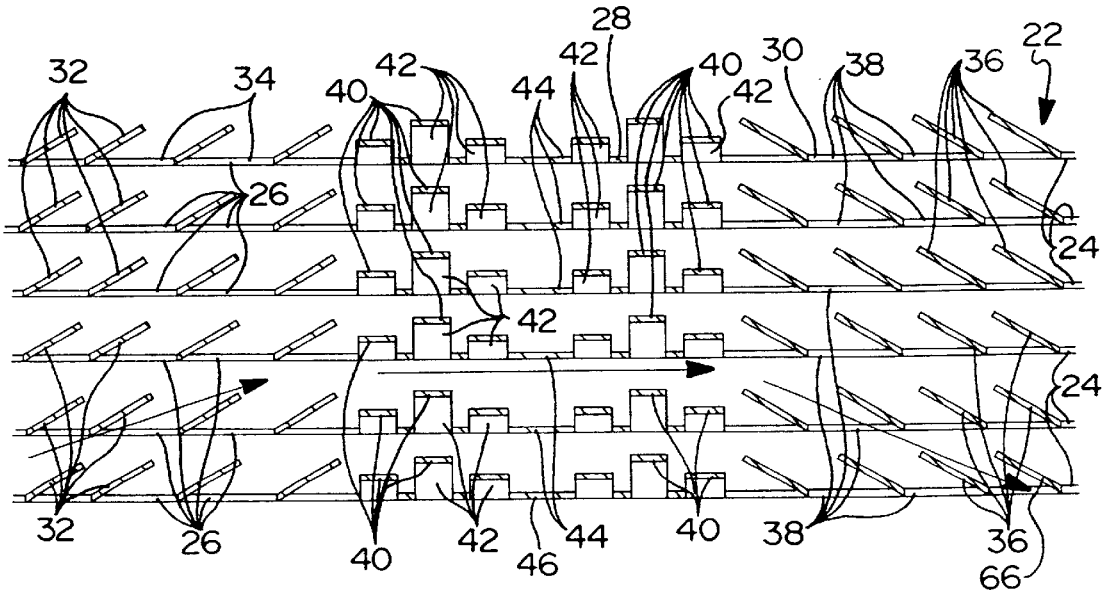
FIG 4

CONTINUOUS COMBINATION FIN FOR A HEAT EXCHANGER

BACKGROUND OF THE INVENTION

1. Field of the Invention

The present invention relates generally to heat exchangers for motor vehicles and, more specifically, to a continuous combination fin for a heat exchanger in a motor vehicle.

2. Description of the Related Art

It is known to provide a louvered fin for a heat exchanger such as an evaporator in a motor vehicle. An example of such a louvered fin is disclosed in U.S. Pat. No. 5,738,168. The louvered fin typically is a corrugated fin having generally planar walls joined in a "V" shape at crests. The louvered fin also has a plurality of louvers bent integrally out of the walls at an angle for the purpose of breaking up airflow over the fins and increasing heat transfer. Further, the louvered fin may have multiple louvers in which the louvers are divided into a pattern of alternating, adjacent sets of louvers to guide airflow in an attempt to induce turbulent flow therein. Commonly, two sets of louvers are used, an entrance set and an exit set separated from one another by a central portion. When air flows over the walls of the louvered fin, the airflow will engage the louvers of the entrance set and be deflected upwardly through the wall at the angle of the entrance set of louvers. Air in the deflected stream flows between a pair of adjacent central portions in two adjacent walls. The air is deflected back through the louvers of the exits set in the same way. It should be appreciated that the airflow has a generally shallow bell curve shape.

Another known louvered fin for a heat exchanger such as an evaporator is disclosed in U.S. Pat. No. 4,580,624. In this patent, groups of louvers are sloped alternately or in different combinations on the fin.

It is also known to provide an off-set strip fin for a heat exchanger. An example of such a fin is disclosed in U.S. Pat. No. 4,615,384. In this patent, the off-set strip fin has a wall with plurality of louvers. separated by a fixed distance from the wall. The louvers are staggered, i. e. arranged alternately on an upper side and a lower side of the wall, so that each pair of louvers adjacent to each other give rise to an empty space for water discharge.

Other examples of known fins for heat exchangers are disclosed in U.S. Pat. No. 3,214,954 and Japanese Patent No. 10-141805. U.S. Pat. No. 3,214,954 discloses a fin roll and Japanese Patent No. 10-141805 discloses a multi-stage fin.

Although the above fins have worked for an evaporator, the louvered fin outperforms the off-set strip fin in heat transfer. On the other hand, the off-set strip fin outperforms the louvered fin in water shedding. Also, the turnaround rib is the weakest heat transfer area of the louvered fin. Therefore, there is a need in the art to provide a continuous combination fin for a heat exchanger that outperforms conventional fins in both heat transfer and water shedding.

SUMMARY OF THE INVENTION

Accordingly, the present invention is a continuous combination fin for a heat exchanger including a base wall having a first portion, a second portion and a third portion. The continuous combination fin also includes a plurality of entrance louvers in the first portion extending outwardly at an angle in a first direction from the base wall. The continuous combination fin includes a plurality of exit louvers in the third portion extending outwardly at an angle in a second direction from the base wall reversed from the first direction. The continuous combination fin further includes a plurality of drainage louvers in at least one of the first portion and the second portion and the third portion that are off-set relative to each other such that air flows through the entrance louvers and exit louvers and water drains through the drainage louvers.

One advantage of the present invention is that a continuous combination fin for a heat exchanger such as an evaporator is provided for a motor vehicle. Another advantage of the present invention is that the continuous combination fin promotes water drainage and enhances heat transfer. Yet another advantage of the present invention is that the continuous combination fin provides two types of louvers to obtain the best performance of both the louvered fin and off-set strip fin. Still another advantage of the present invention is that the continuous combination fin provides a relatively large louver angle and a relatively small louver pitch. A further advantage of the present invention is that the continuous combination fin provides a flexible fin roll that can have a family of three or more different combinations.

Other features and advantages of the present invention will be readily appreciated, as the same becomes better understood after reading the subsequent description taken in conjunction with the accompanying drawings.

BRIEF DESCRIPTION OF THE DRAWINGS

FIG. 1 is an elevational view of a continuous combination fin, according to the present invention, illustrated in operational relationship with a heat exchanger.

FIG. 2 is an enlarged perspective view of the continuous combination fin of FIG. 1.

FIG. 3 is an elevational view of the continuous combination fin of FIG. 1.

FIG. 4 is a sectional view taken along line 4—4 of FIG. 3.

DESCRIPTION OF THE PREFERRED EMBODIMENT(S)

Figure 5:
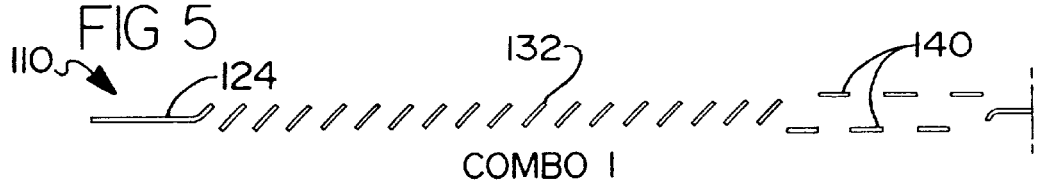
FIG. 5 is a view similar to FIG. 4 of another embodiment, according to the present invention of the continuous combination fin of FIG. 1.

Referring to the drawings and in particular FIG. 1, one embodiment of a heat exchanger 10, such as an evaporator, is shown for a motor vehicle (not shown). The heat exchanger 10 includes a plurality of generally parallel and U-shaped plates or tubes 12 and a header 14 connected to one end of the tubes 12. The heat exchanger 10 includes a fluid inlet 16 for conducting cooling fluid into the heat exchanger 10 formed in the header 14 and an outlet 18 for directing fluid out of the heat exchanger 10 formed in the header 14. The heat exchanger 10 also includes a plurality of convoluted or serpentine continuous combination fins, generally indicated at 22 and according to the present invention, attached an exterior of each of the tubes 12. The continuous combination fins 22 are disposed between each of the tubes 12. The continuous combination fins 22 serve as a means for conducting heat away from the tubes 12 while providing additional surface area for convective heat transfer by air flowing over the heat exchanger 10. It should be appreciated that, except for the continuous combination fins 22, the heat exchanger 10 is conventional and known in the art. It should also be appreciated that the continuous combination fins 22 could be used for heat exchangers in other applications besides motor vehicles.

Referring to FIGS. 2 through 4, the continuous combination fin 22 includes at least one, preferably a plurality of base walls 24 joined to one another in generally "V" shaped corrugations. Each base wall 24 is generally planar and rectangular shape. Each base wall 24 extends longitudinally to form a first portion 26, second portion 28 and third portion 30. The base wall 24 is made of a metal material such as aluminum or an alloy thereof.

The continuous combination fin 22 also includes a plurality of first or entrance louvers 32 in the first portion 26 extending outwardly at a relatively large or predetermined louver angle such as forty-three degrees (43°) in a first direction from the base wall 24. The entrance louvers 32 are generally planar and rectangular in shape. The entrance louvers 32 extend laterally or generally perpendicular to a longitudinal axis of the base wall 24. The entrance louvers 32 are pierced and bent out of the base wall 24 to form apertures 34 for air to flow therebetween. The entrance louvers 32 are spaced longitudinally at a relatively small or predetermined louver pitch such as 0.8 millimeters (mm) to 1.0 mm to enhance heat transfer.

The continuous combination fin 22 includes a plurality of second or exit louvers 36 in the third portion 30 extending outwardly at a relatively large or predetermined louver angle such as forty-three degrees (43°) in a second direction reversed from or opposite the first direction. The exit louvers 36 are generally planar and rectangular in shape. The exit louvers 36 extend laterally or generally perpendicular to the longitudinal axis of the base wall 24. The exit louvers 36 are pierced and bent out of the base wall 24 to form apertures 38 for air to flow therebetween. The exit louvers 36 are spaced longitudinally at a relatively small or predetermined louver pitch such as 0.8 millimeters (mm) to 1.0 mm to enhance heat transfer. It should be appreciated that the louvers 32 and 36 enhance heat transfer performance.

The continuous combination fin 22 further includes a plurality of third or drainage louvers 40 in the second portion 28 extending outwardly and generally parallel to the base wall 24. The drainage louvers 40 are generally planar and rectangular in shape. The drainage louvers 40 extend laterally or generally perpendicular to the longitudinal axis of the base wall 24. The drainage louvers 40 are pierced and off-set out of the base wall 24 a distance therefrom to form apertures 42 for fluid such as water to drain therebetween. The drainage louvers 40 may be staggered or arranged alternately on both sides of the base wall 24. It should be appreciated that the drainage louvers 40 are off-set relative to each other. It should also be appreciated that the off-set drainage louvers 40 enhance water shedding/drainage.

The continuous combination fin 22 includes a central turnaround rib 44 in the second portion 28 between a first set of drainage louvers 40 adjacent the entrance louvers 32 and a second set of drainage louvers 36 adjacent the exit louvers 36. The continuous combination fin 22 is formed as a monolithic structure being integral, unitary and one-piece.

In operation of the continuous combination fin 22, air flows between the base walls 24 as indicated by the arrows in FIG. 4. The air engages the entrance louvers 32 and is deflected through the apertures 34 in the first portion 26 of the base wall 24. The deflected air is impacted by air flowing straight between the base walls 24. The air flows generally parallel between a pair of second portions 28 in two adjacent base walls 24. The air flows past the drainage louvers 40 and the turn-around rib 44 where heat transfer is the weakest and water in the air condenses such that the condensed water drains through the apertures 42 in the second portion 28 of the base wall 24. The air engages the exit louvers 36 and is deflected through the apertures 38 in the third portion 30 of the base wall 24. It should be appreciated that the airflow has a shape similar to a shallow flat bell curve.

Referring to FIG. 5, another embodiment, according to the present invention, of the continuous combination fin 10 is shown. Like parts of the continuous combination fin 10 have like reference numerals increased by one hundred (100). In this embodiment, the continuous combination fin 110 has the drainage louvers 140 formed from the base wall 124 disposed above and below a plane of the base wall 124. It should be appreciated that the continuous combination fin 110 is symmetrical about a centerline C.

Figure 6:
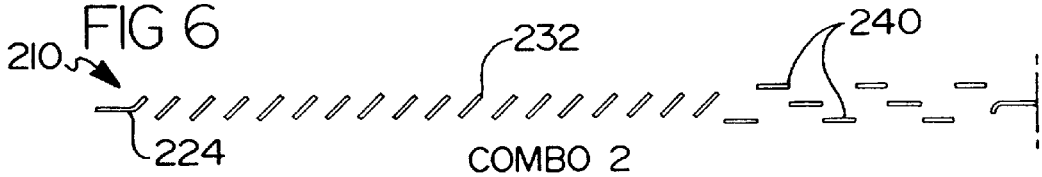
FIG. 6 is a view similar to FIG. 4 of yet another embodiment, according to the present invention of the continuous combination fin of FIG. 1.

Referring to FIG. 6, yet another embodiment, according to the present invention, of the continuous combination fin 10 is shown. Like parts of the continuous combination fin 10 have like reference numerals increased by two hundred (200). In this embodiment, the continuous combination fin 210 has the drainage louvers 240 disposed above and below the base wall 224 with portions of the base wall 224 therebetween. It should be appreciated that the continuous combination fin 210 is symmetrical about a centerline C.

Figure 7:
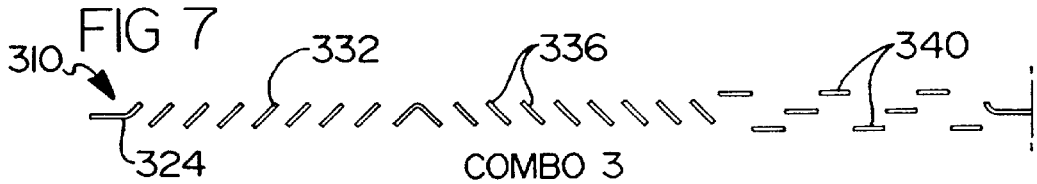
FIG. 7 is a view similar to FIG. 4 of still another embodiment, according to the present invention of the continuous combination fin of FIG. 1.

Referring to FIG. 7, still another embodiment, according to the present invention, of the continuous combination fin 10 is shown. Like parts of the continuous combination fin 10 have like reference numerals increased by three hundred (300). In this embodiment, the continuous combination fin 310 has exit louvers 336 disposed between the entrance louvers 332 and the drainage louvers 340. The drainage louvers 340 are disposed above and below the base wall 324 with portions of the base wall 324 therebetween. It should be appreciated that the continuous combination fin 310 is symmetrical about a centerline C.

Figure 8:
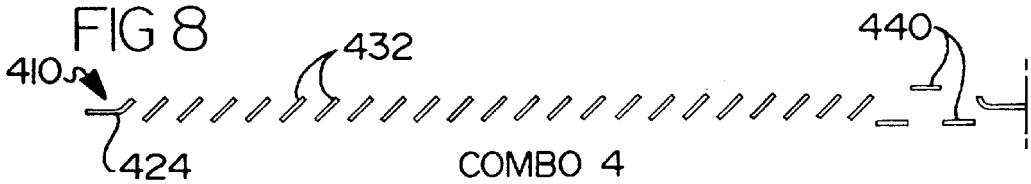
FIG. 8 is a view similar to FIG. 4 of a further embodiment, according to the present invention of the continuous combination fin of FIG. 1.

Referring to FIG. 8, a further embodiment, according to the present invention, of the continuous combination fin 10 is shown. Like parts of the continuous combination fin 10 have like reference numerals increased by four hundred (100). In this embodiment, the continuous combination fin 410 has the drainage louvers 440 formed from the base wall 424 disposed above and below a plane of the base wall 424. It should be appreciated that the continuous combination fin 410 is symmetrical about a centerline C.

Figure 9:
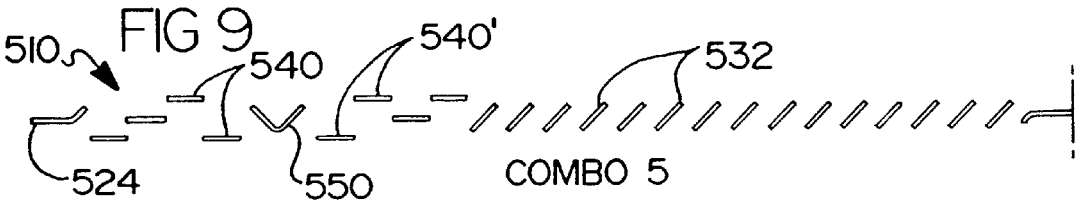
FIG. 9 is a view similar to FIG. 4 of a yet further embodiment, according to the present invention of the continuous combination fin of FIG. 1.

Referring to FIG. 9, a yet further embodiment, according to the present invention, of the continuous combination fin 10 is shown. Like parts of the continuous combination fin 10 have like reference numerals increased by five hundred (500). In this embodiment, the continuous combination fin 510 has a first plurality of drainage louvers 540 separated by a generally V-shaped divider 550 by a second plurality of drainage louvers 540'. The drainage louvers 540 and 540' are disposed above and below the base wall 524 with portions of the base wall 524 therebetween. The drainage louvers 540 and 540' are disposed before the entrance louvers 532 and after the exit louvers (not shown). It should be appreciated the continuous combination fin 510 is symmetrical about a centerline C.

Figure 10:
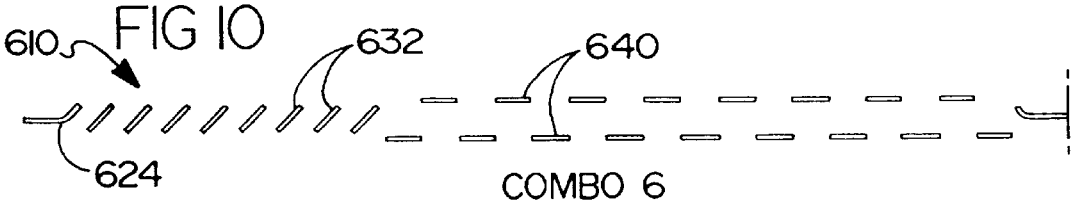
FIG. 10 is a view similar to FIG. 4 of a still further embodiment, according to the present invention of the continuous combination fin of FIG. 1.

Referring to FIG. 10, a still further embodiment, according to the present invention, of the continuous combination fin 10 is shown. Like parts of the continuous combination fin 10 have like reference numerals increased by six hundred (600). In this embodiment, the continuous combination fin 610 has the drainage louvers 640 formed from the base wall 624 disposed above and below a plane of the base wall 624. The drainage louvers 640 extend longitudinally a distance greater than a distance of the entrance louvers 632. It should be appreciated that the continuous combination fin 610 is symmetrical about a centerline C.

Figure 11:
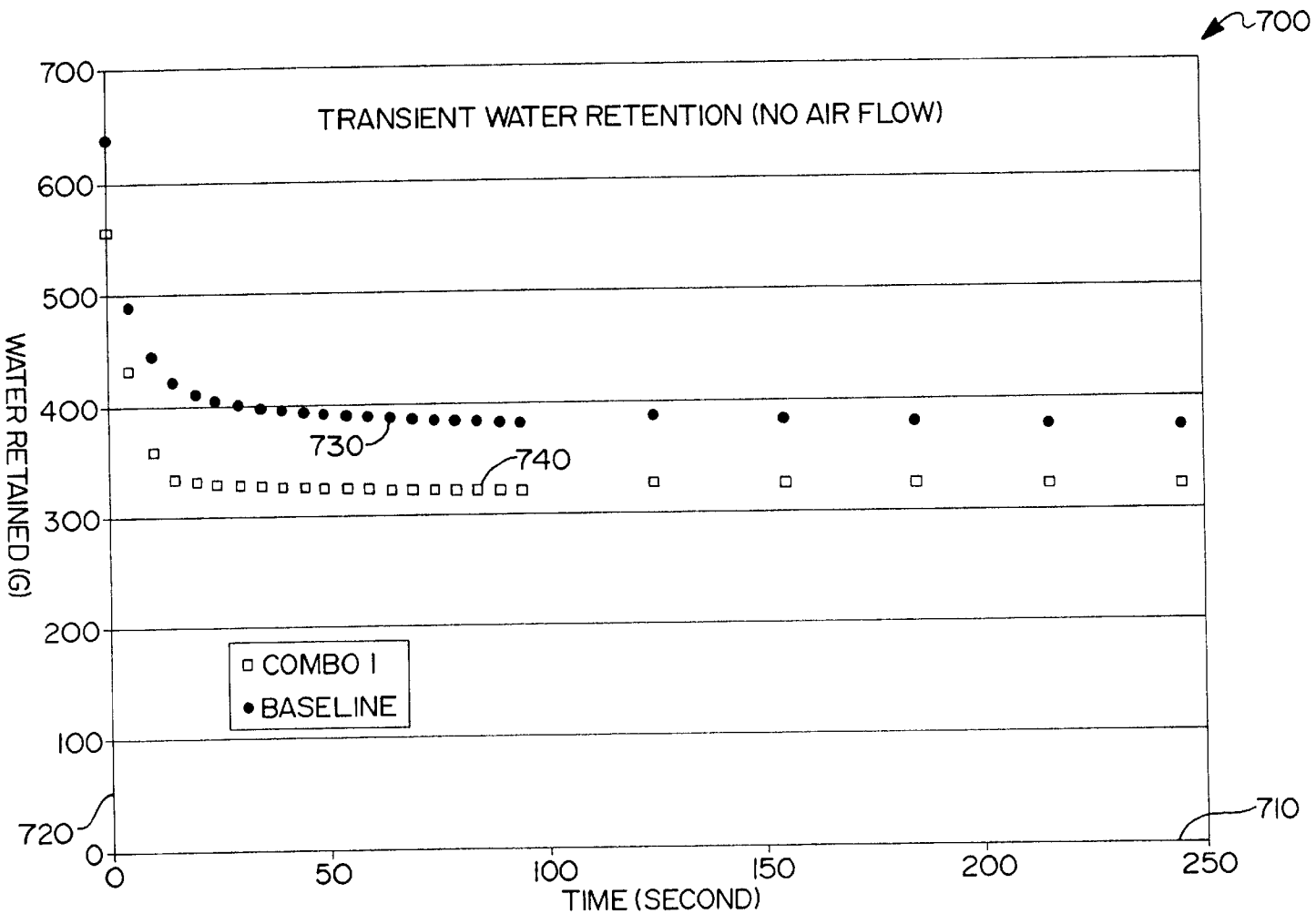
FIG. 11 is a graph of transient water retention for the continuous combination fin of FIG. 5 versus a baseline fin.

Referring to FIG. 11, a graph 700 of transient water retention for the continuous combination fin 110 of FIG. 5 is shown. The graph 700 has time (in seconds) on an x-axis 710 and water retained (in grams) on a y-axis 720. The graph 700 has a curve 730 of transient water retention (no airflow) for a baseline fin (not shown), which is a conventional louvered fin and a curve 740 of transient water retention of the continuous combination fin 110. As illustrated, the continuous combination fin 110 retains less water over time than the baseline fin.

Figure 12:
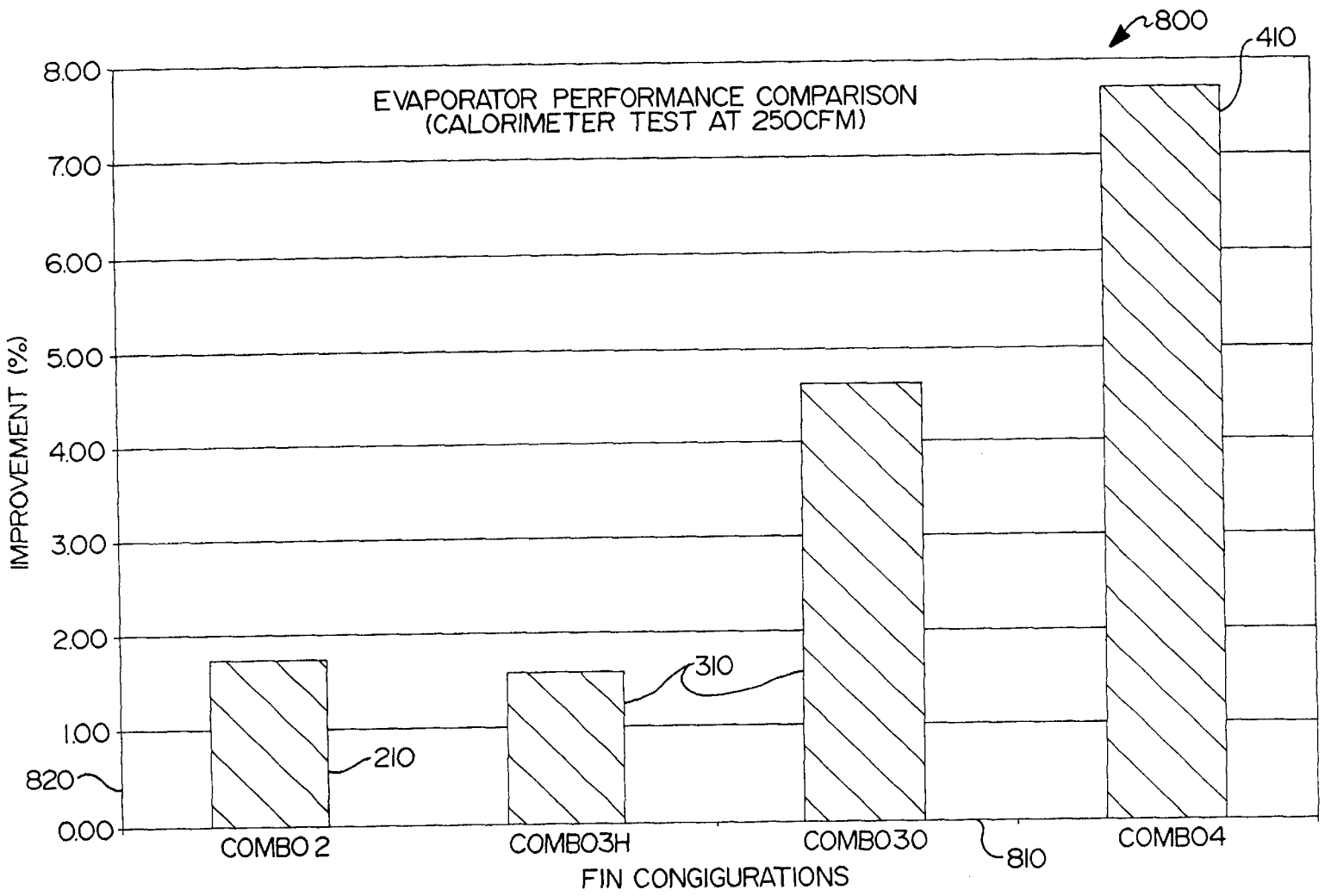
FIG. 12 is a graph of evaporator performance comparison for the continuous combination fin of FIGS. 7 through 10.

Referring to FIG. 12, a graph 800 of evaporator performance comparison for the continuous combination fins 210, 310, and 410 is shown. The graph 800 has fin configurations 210, 310 and 410 on an x-axis 810 and percent improvement on a y-axis 820. The evaporator performance comparison was carried out using a calorimeter test at 250 cfm for the continuous combination fins versus conventional louvered fins. As illustrated, the continuous combination fin 410 performed the best while all continuous combination fins 210,310,410 performed better than conventional louvered fins.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A continuous combination fin for a heat exchanger comprising:

a base wall having a first portion, a second portion and a third portion;

a plurality of entrance louvers in said first portion extending outwardly at a predetermined angle in a first direction from said base wall, said entrance louvers extending generally perpendicular to a longitudinal axis of said base wall and spaced longitudinally therealong;

a plurality of exit louvers in said third portion extending outwardly at a predetermined angle in a second direction from said base wall reversed from the first direction, said exit louver extending generally perpendicular to the longitudinal axis of said base wall and spaced longitudinally therealong; and a plurality of drainage louvers in one of said first portion and said second portion and said third portion, said drainage louvers extending generally perpendicular to the longitudinal axis of said base wall and spaced longitudinally therealong and being off-set vertically from said base wall a distance therefrom to form first apertures being disposed below said drainage louvers such that air flows through said entrance louvers and exit louvers and water drains through said drainage louvers.

2. A continuous combination fin as set forth in claim 1 wherein said base wall is generally planar and rectangular in shape.

3. A continuous combination fin as set forth in claim 1 wherein said first portion includes a plurality of second apertures extending through said base wall, one of said second apertures being disposed between an adjacent pair of said entrance louvers for air to flow therebetween.

4. A continuous combination fin as set forth in claim 3 wherein each of said entrance louvers are formed from said base wall at the angle to form said second apertures.

5. A continuous combination fin as set forth in claim 1 wherein said third portion includes a plurality of third apertures extending through said base wall, one of said third apertures being disposed between an adjacent pair of said exit louvers for air to flow therebetween.

6. A continuous combination fin as set forth in claim 5 wherein each of said exit louvers are formed from said base wall at said predetermined angle to form said third apertures.

7. A continuous combination fin as set forth in claim 1 wherein said second portion includes said first apertures extending through said base wall, one of said first apertures being disposed below one of said drainage louvers for water to drain therebetween.

8. A continuous combination fin as set forth in claim 1 including a plurality of said base walls joined to one another in generally V shaped corrugations.

9. A continuous combination fin as set forth in claim 1 wherein said base wall, said entrance louvers, said exit louvers and said drainage louvers are integral, unitary and formed as one-piece.

10. A continuous combination fin for a heat exchanger comprising:

a base wall having a first portion, a second portion and a third portion;

a plurality of entrance louvers in said first portion extending outwardly at a predetermined angle in a first direction from said base wall, said entrance louvers extending generally perpendicular to a longitudinal axis of said base wall and spaced longitudinally therealong;

a plurality of exit louvers in said third portion extending outwardly at a predetermined angle in a second direction from said base wall reversed from the first direction, said exit louvers extending generally perpendicular to the longitudinal axis of said base wall and spaced longitudinally therealong;

a plurality of drainage louvers in one of said first portion and said second portion and said third portion, said drainage louvers extending generally perpendicular to the longitudinal axis of said base wall and spaced longitudinally therealong and being off-set relative to each other such that air flows through said entrance louvers and exit louvers and water drains through said drainage louvers;

wherein said second portion includes a plurality of apertures extending through said base wall, one of said apertures being disposed below one of said drainage louvers for water to drain therebetween; and wherein each of said drainage louvers are formed from said base wall generally parallel thereto to form said apertures.

11. A continuous combination fin for a heat exchanger comprising:

a base wall having a first portion, a second portion and a third portion;

a plurality of entrance louvers and first apertures in said first portion, said entrance louvers extending outwardly at a predetermined angle in a first direction from said base wall and one of said first apertures being disposed between a pair of adjacent said entrance louvers, said entrance louvers extending generally perpendicular to a longitudinal axis of said base wall and spaced longitudinally therealong;

a plurality of exit louvers and second apertures in said third portion, said exit louvers extending outwardly at a predetermined angle in a second direction from said base wall reversed from the first direction and one of said second apertures being disposed between a pair of adjacent said exit louvers, said exit louvers extending generally perpendicular to the longitudinal axis of said base wall and spaced longitudinally therealong; and a plurality of drainage louvers and third apertures in one of said first portion and said second portion and said third portion, said drainage louvers extending generally perpendicular to the longitudinal axis of said base wall and spaced longitudinally therealong and being off-set vertically from said base wall a distance therefrom and said third apertures being disposed below said drainage louvers such that air flows through said entrance louvers and exit louvers and water drains through said drainage louvers.

12. A continuous combination fin as set forth in claim 11 wherein said base wall is generally planar and rectangular in shape.

13. A continuous combination fin as set forth in claim 11 wherein each of said entrance louvers are formed from said base wall at said predetermined angle to form said first apertures.

14. A continuous combination fin as set forth in claim 11 wherein each of said exit louvers are formed from said base wall at said predetermined angle to form said second apertures.

15. A continuous combination fin as set forth in claim 11 wherein said second portion includes said third apertures extending through said base wall, one of said third apertures being disposed below one of said drainage louvers for water to drain therebetween.

16. A continuous combination fin as set forth in claim 11 including a plurality of said base walls joined to one another in generally V shaped corrugations.

17. A continuous combination fin as set forth in claim 11 wherein said base wall, said entrance louvers, aid exit louvers and said drainage louvers are integral, unitary and formed as one-piece.

18. A continuous combination fin as set forth in claim 11 wherein said base wall is made of a metal material.

19. A continuous combination fin for a heat exchanger comprising:

a base wall having a first portion, a second portion and a third portion;

a plurality of entrance louvers and first apertures in said first portion, said entrance louvers extending outwardly at a predetermined angle in a first direction from said base wall and one of said first apertures being disposed between a pair of adjacent said entrance louvers, said entrance louvers extending generally perpendicular to a longitudinal axis of said base wall and spaced longitudinally therealong;

a plurality of exit louvers and second apertures in said third portion, said exit louvers extending outwardly at a predetermined angle in a second direction from said base wall reversed from the first direction and one of said second apertures being disposed between a pair of adjacent said exit louvers, said exit louvers extending generally perpendicular to the longitudinal axis of said base wall and spaced longitudinally therealong;

a plurality of drainage louvers and third apertures in one of said first portion and said second portion and said third portion, said drainage louvers extending generally perpendicular to the longitudinal axis of said base wall and spaced longitudinally therealong and being off-set relative to each other such that air flows through said entrance louvers and exit louvers and water drains through said drainage louvers;

wherein said second portion includes a plurality of third apertures extending through said base wall, one of said third apertures being disposed below one of said drainage louvers for water to drain therebetween; and wherein each of said drainage louvers are formed from said base wall generally parallel thereto to form said third apertures.

20. A heat exchanger comprising:

a plurality of tubes;

a plurality of continuous combination fins disposed between each of said tubes; and each of said continuous combination fins comprising a base wall having a first portion, a second portion and a third portion, and a plurality of entrance louvers and first apertures in said first portion, said entrance louvers extending outwardly at a predetermined angle in a first direction from said base wall and one of said first apertures being disposed between a pair of adjacent said entrance louvers, said entrance louvers extending generally perpendicular to a longitudinal axis of said base wall and spaced longitudinally therealong, a plurality of exit louvers and second apertures in said third portion, said exit louvers extending outwardly at a predetermined angle in a second direction from said base wall reversed from the first direction and one of said second apertures being disposed between a pair of adjacent said exit louvers, said exit louvers extending generally perpendicular to the longitudinal axis of said base wall and spaced longitudinally therealong, and a plurality of drainage louvers and third apertures in said second portion, said drainage louvers being formed generally parallel to said base wall and one of said third apertures being disposed below one of said drainage louvers, said drainage louvers extending generally perpendicular to the longitudinal axis of said base wall and spaced longitudinally therealong and being off-set relative to each other and said base wall such that air flows through said entrance louvers and exit louvers and water drains through said third apertures.

* * * * *